US006370798B1

(12) United States Patent
Gonzalez, Sr.

(10) Patent No.: US 6,370,798 B1
(45) Date of Patent: Apr. 16, 2002

(54) CLOTHES DRYER WITH VACUUM ASSISTANCE

(76) Inventor: Felipe Gonzalez, Sr., 6810 Maple Lake St., San Antonio, TX (US) 78244

( * ) Notice: Subject to any disclaimer, the term of this patent is extended or adjusted under 35 U.S.C. 154(b) by 0 days.

(21) Appl. No.: 09/773,362

(22) Filed: Jan. 31, 2001

(51) Int. Cl.[7] ..... F26B 11/02
(52) U.S. Cl. ..... 34/595; 219/544
(58) Field of Search ..... 219/200, 201, 219/221, 544; 34/595, 92, 599, 139, 140

(56) References Cited

U.S. PATENT DOCUMENTS

| | | | | | |
|---|---|---|---|---|---|
| 2,555,821 | A | * | 6/1951 | Smith | 34/92 |
| 3,238,750 | A | * | 3/1966 | Candor et al. | 34/92 |
| 4,041,614 | A | * | 8/1977 | Robinet | 34/92 |
| 4,057,907 | A | | 11/1977 | Rapino et al. | 34/4 |
| 4,257,173 | A | | 3/1981 | Smith | 34/92 |
| 4,615,125 | A | * | 10/1986 | Wyborn | 34/92 |
| 5,131,169 | A | * | 7/1992 | Jaster | 34/15 |
| 5,357,771 | A | | 10/1994 | Schaal | 68/18 |
| 5,459,945 | A | * | 10/1995 | Shulenberger | 34/605 |
| 5,724,750 | A | | 3/1998 | Burress | 34/267 |

* cited by examiner

*Primary Examiner*—Teresa Walberg
*Assistant Examiner*—Thor Campbell
(74) *Attorney, Agent, or Firm*—Wayne J. Colton, Inc

(57) ABSTRACT

A vacuum assisted dryer for accelerated drying of clothing generally comprises a fixed frame, a rotatable drum within the fixed frame for holding and tumbling clothing within a vacuum sealable interior space, a vacuum pump fixedly attached to the drum and a power delivery system for communicating electrical power from the fixed frame to the vacuum source on the drum. The power delivery system comprises a slip ring assembly about a spindle utilized to maintain the drum upon its axis of rotation inside the fixed frame. A plurality of heating pads are provided about the interior of the drum to facilitate drying of the clothing. A blower assembly evacuates to a conventional dryer vent moist air exhausted from the vacuum pump.

19 Claims, 4 Drawing Sheets

CLOTHES DRYER WITH VACUUM ASSISTANCE

FIELD OF THE INVENTION

The present invention relates to clothes dryers. More particularly, the invention relates to a clothes dryer having a vacuum pump integral therewith to create sub-atmospheric pressures within the drum, thereby facilitating the drying of clothing and/or reducing the energy costs associated therewith.

BACKGROUND OF THE INVENTION

The desire for time and energy conservation has led to many useful developments of household appliances. In particular, a clothes dryer with an integral vacuum source has been proven to be more energy efficient that a conventional clothes dryer. A directly proportional relationship between temperature and pressure allows the evaporation temperature of the water in the clothing to be reduced as barometric pressure within the dryer is decreased. This phenomenon provides many advantages, including reduced drying times and temperatures as well as less damage to clothing.

In the past, others have taken advantage of this phenomenon in an attempt to produce a more efficient clothes dryer. For example, U.S. Pat. No. 5,724,750 issued Mar. 10, 1998 to Burress ("Burress") discloses a clothes dryer with infrared heating and vacuum drying capabilities in which a stationary vacuum pump is capable of reducing the vacuum pressure inside the drum to a sub-atmospheric pressure. Likewise, U.S. Pat. No. 4,057,907 issued Nov. 15, 1777 to Rapino et al. ("Rapino") details an apparatus having a vacuum pump that reduces the air pressure within a chamber, while a microwave emitter excites the water molecules. The apparatus of Burress and Rapino, however, each employ a rotating shaft and/or bearing assembly at their interface between internal regions of atmospheric and sub-atmospheric pressure.

Unfortunately, Applicant has found that the embodiments exemplified by the prior art are extremely difficult to implement. In order to obtain the tight seal necessary for maintaining the apparatus' internal vacuum, a soft bushing material, such as rubber or the like, must be utilized. Such a soft material, however, quickly wears, ultimately resulting in disintegration of the seal. On the other hand, hard materials that are impervious to wear are highly susceptible to tiny vacuum leaks, which in turn destroy the object of the invention.

It is therefore an overriding object of the present invention to provide a clothes dryer that incorporates vacuum assistance without the disadvantages inherent in the prior art. It is a further object of the present invention to provide such a clothes dryer that eliminates the need for a sealed bearing or rotating shaft extended between regions of atmospheric and sub-atmospheric pressure, thereby increasing the reliability of the appliance. Finally, it is an object of the present invention to provide such a clothes dryer that is economical to manufacture.

SUMMARY OF THE INVENTION

In accordance with the foregoing objects, the present invention—a vacuum assisted dryer for accelerated drying of clothing—generally comprises a fixed frame, a rotatable drum within the fixed frame for holding and tumbling clothing within a vacuum sealable interior space, a vacuum source fixedly attached to the drum and a power delivery system for communicating electrical power from the fixed frame to the vacuum source on the drum. Preferably, the vacuum source comprises a vacuum pump and the power delivery system comprises a slip ring assembly about a spindle utilized to maintain the drum upon its axis of rotation inside the fixed frame.

In at least one embodiment, a plurality of heating pads are provided about the interior of the drum for imparting increased temperature to the clothing held therein, thereby further facilitating drying of the clothing. The heating pads may be conveniently located within paddles conventionally placed for the tumbling of clothing and may be powered through the same slip ring assembly as powers the vacuum source. A lint screen is also preferably interposed the vacuum source and the interior space of the drum, thereby preventing harm to the vacuum source from lint and the like.

The vacuum source exhausts to the interior space of the fixed frame, where moist air may be evacuated from the system with a blower assembly. The blower assembly maintains airflow from without the frame, about the interior of the frame and into and out of a duct to a conventional household dryer vent.

A vacuum relief for relieving vacuum pressure from within the drum is also preferably provided. Such a vacuum relief may comprises a valve in fluid communication with the interior space of the drum. In particular, Applicant has found suitable the use of a stopcock-type valve.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
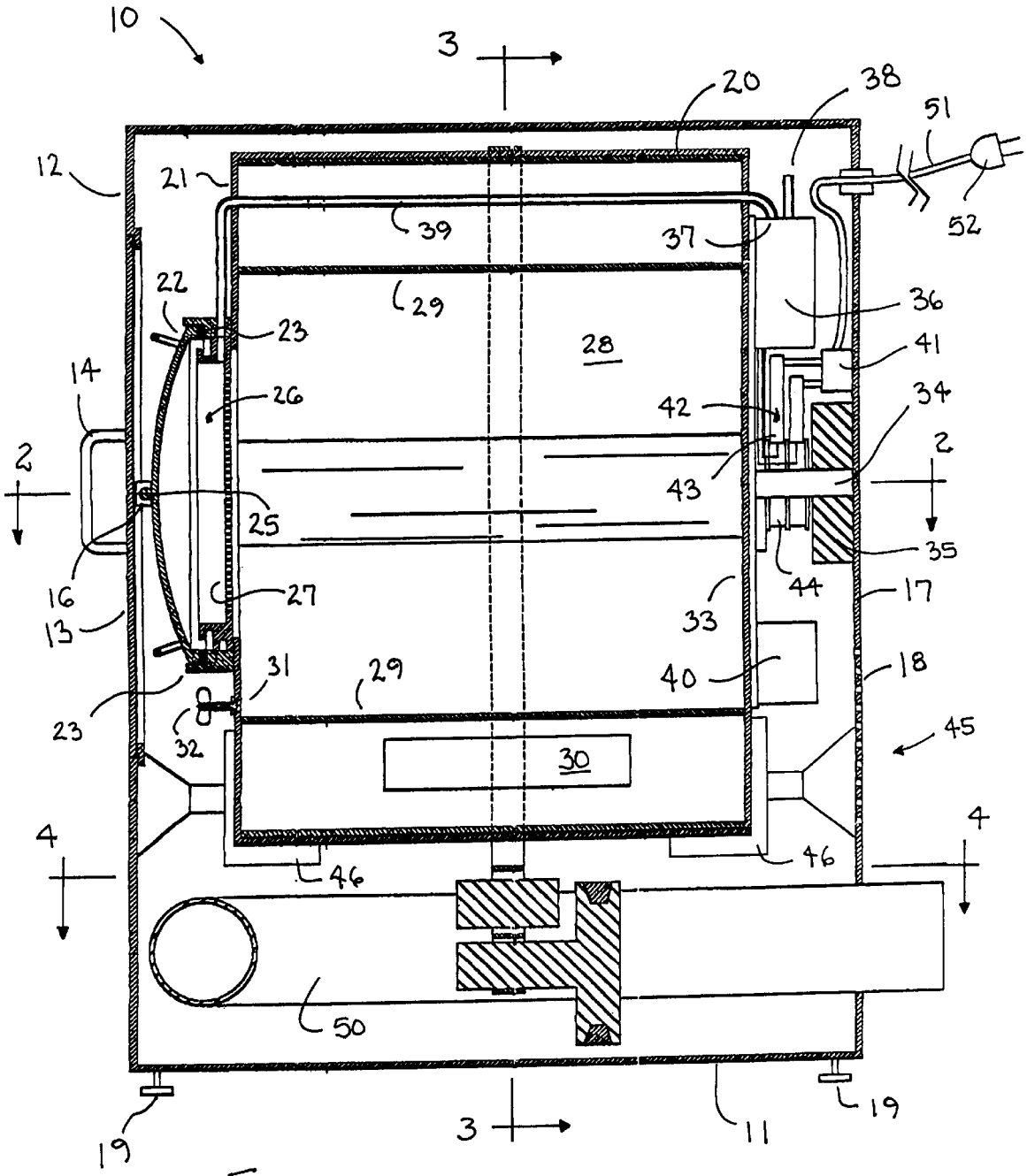
FIG. 1 shows, in a left side cross-sectional view taken through line 1—1 of FIG. 2, the vacuum assisted clothing dryer of the present invention.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the clothes dryer 10 of the present invention is shown to generally comprise a drum 20 rotatably enclosed within a fixed housing 11. A vacuum pump 36 is utilized to reduce the atmospheric pressure within an interior space 28 of the drum 20, thereby facilitating the drying of clothing held therein. As will be better understood further herein, the vacuum pump 36 is fixedly attached to and rotates with the drum 20, which eliminates the requirement for vacuum sealed bearings and the like for communication of vacuum pressure to the interior space 28 of the drum 20. This limitation eliminated, the clothes dryer 10 of the present invention is adapted to utilize principles of vacuum assisted drying without the high maintenance costs associated with the prior art.

Figure 2:
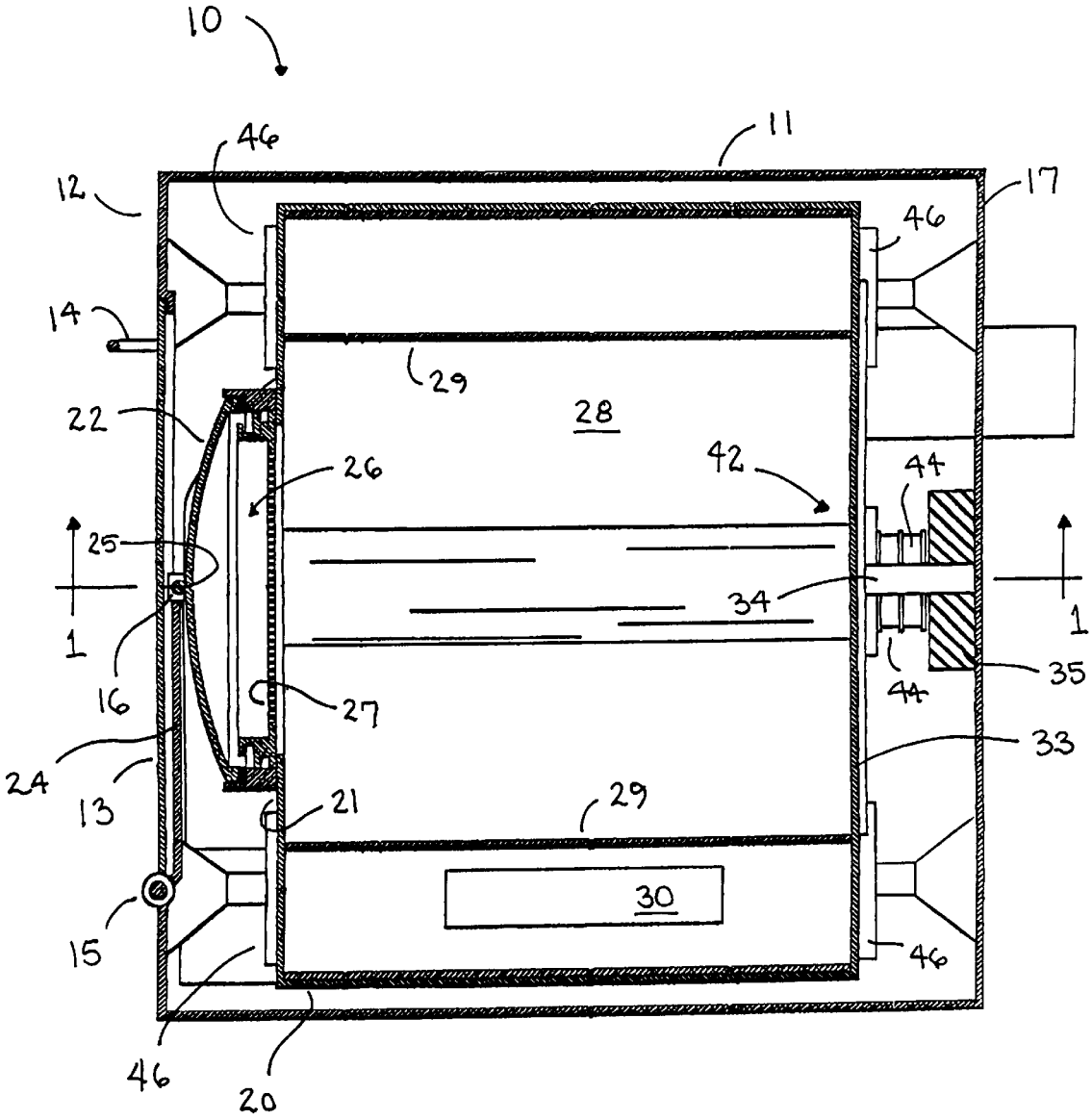
FIG. 2 shows, in a top cross-sectional view taken through line 2—2 of FIG. 1, the dryer of FIG. 1.
Figure 3:
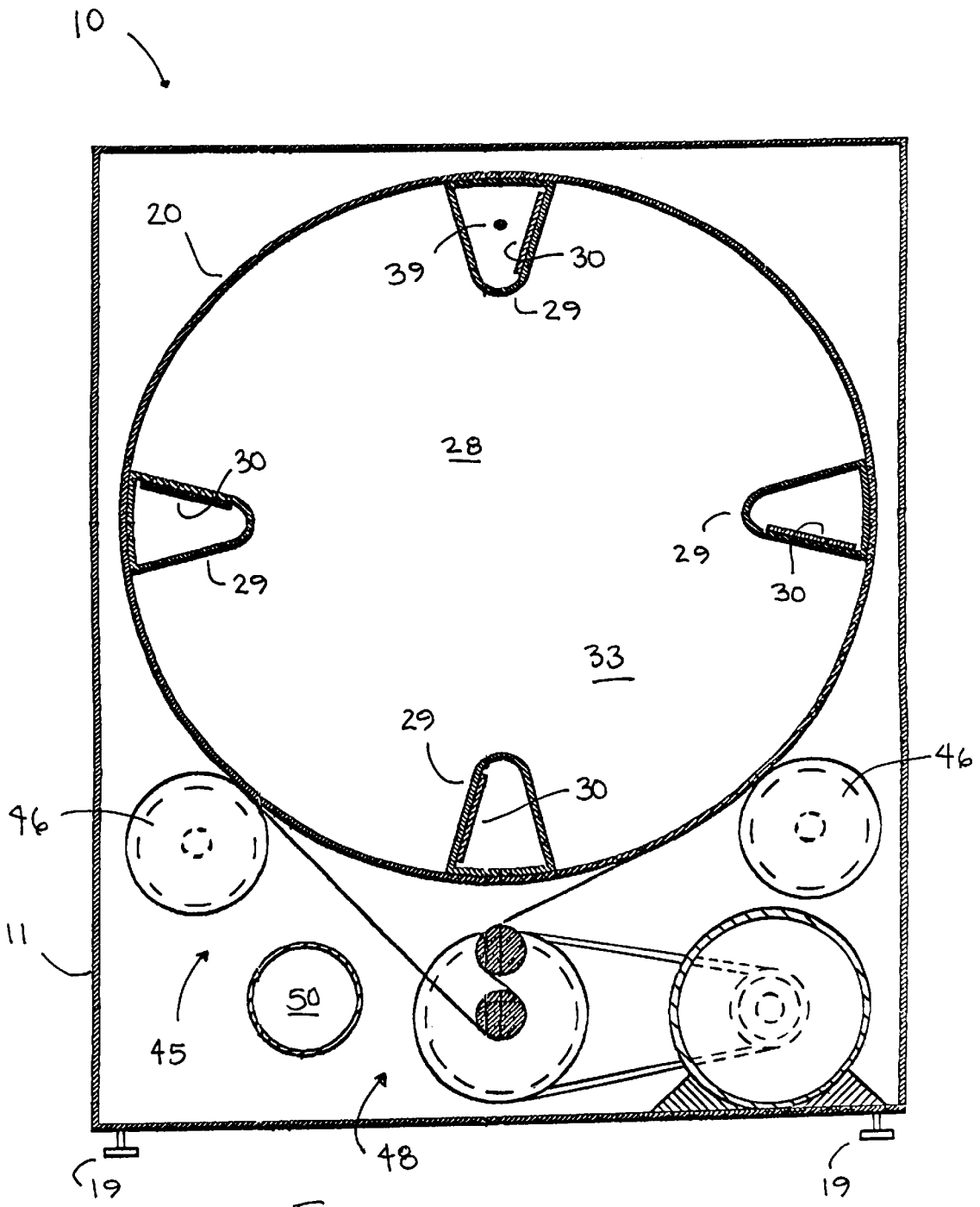
FIG. 3 shows, in a front elevational cross-sectional view taken through line 3—3 of FIG. 1, the dryer of FIG. 1.
Figure 4:
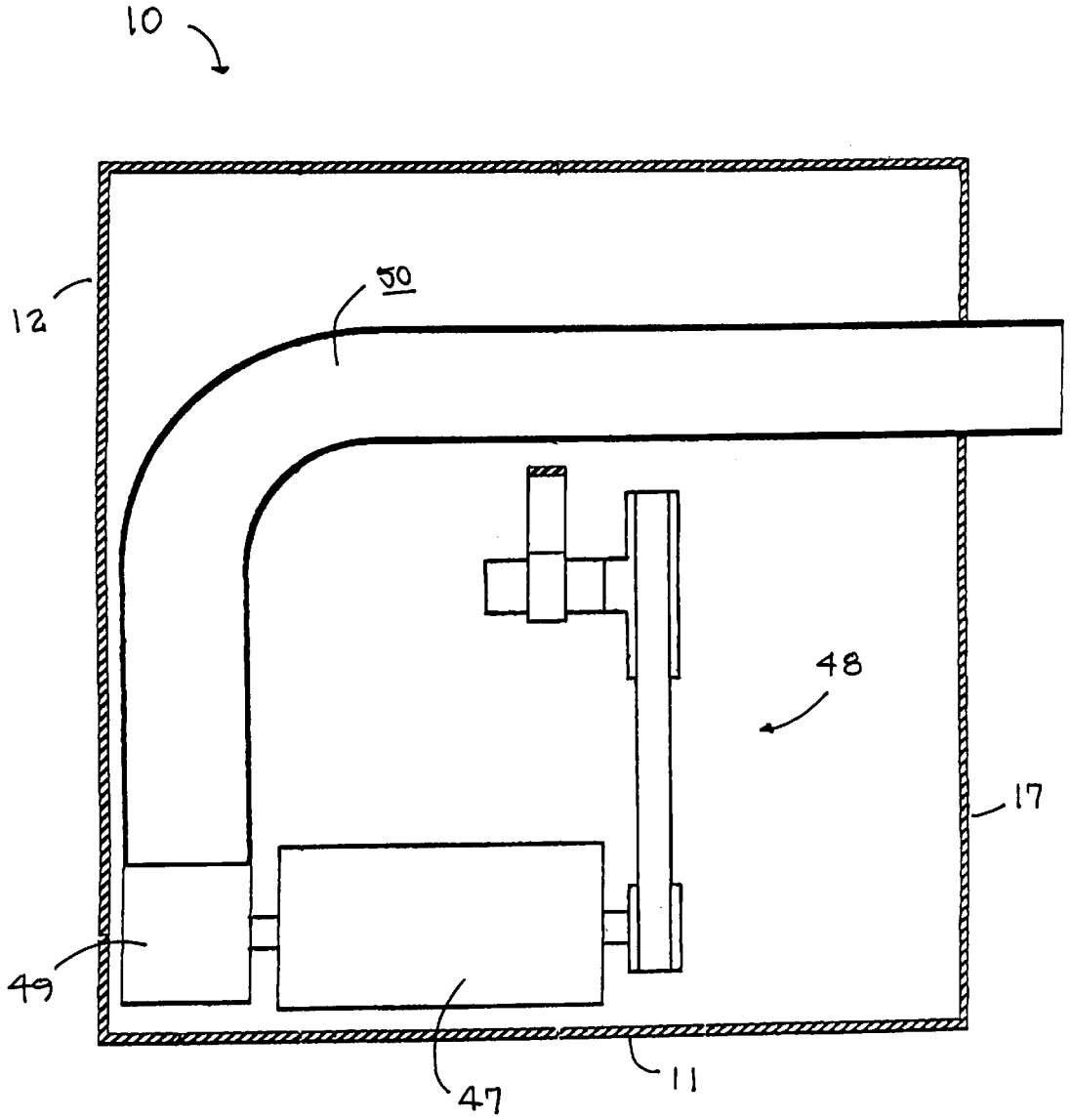
FIG. 4 shows, in a top cross-sectional view taken through line 4—4 of FIG. 1; details of the drive mechanism and blower assembly of the dryer of FIG. 1.

As typical of currently available clothes dryers, the clothes dryer 10 of the present invention comprises a drum support system 45 for rotatably supporting the drum 20 within the fixed housing 11. In particular, a plurality of rollers 46 are provided upon which the drum 20 rests. Additionally, however, provision is made in the present invention for maintaining the drum 20 on its axis of rotation. As shown in FIGS. 1 and 2, a vacuum door 22 through the front end 21 of the drum 20 is centrally fitted with a spherical bearing 25 for engaging a socket 16 at the distal end of a support arm 24 extending from an access door 13 through the front panel 12 of the fixed housing 11. Similarly, a spindle 34 extending from the rear end 33 of the drum 20 engages a bearing 35 fixedly attached to the interior face of the rear panel 17 of the fixed housing 11. As will be appreciated by those of ordinary skill in the art, the spherical bearing 25 engages the socket 16 in the axis of rotation of the drum 20. Likewise, the spindle 34 engages the bearing 35 in the same axis of rotation, thereby cooperating with the spherical bearing 25 and socket 16 combination to retain the drum 20 within its axis of rotation upon the drum support system 45. In this manner, as will be better understood further herein, delivery of electrical power from the fixed housing 11 to the rotating drum 20 is facilitated.

As previously discussed, a vacuum pump 36 is utilized to reduce the atmospheric pressure within the interior space 28 of the drum 20. As also previously discussed, it is critical to the present invention to avoid sealed bearings, rotating shafts or the like between regions of subatmospheric atmospheric and pressure inside and outside, respectively, of the drum 20. To this end, the vacuum pump 26 is dependently affixed directly to the drum 20 and rotates therewith. As particularly shown in FIG. 1, the vacuum pump 36 comprises a vacuum inlet 37 in fluid communication with the interior space 28 of the drum 20 through a provided vacuum line 39. Preferably, the vacuum line 39 terminates in an exterior pocket 26 at the front end 21 of the drum 20. In this manner, a lint filter 27 may be interposed the interior space 28 and the vacuum line 39 to the vacuum pump 36, thereby preventing the introduction to the vacuum pump 36 of lint and/or other foreign objects.

Because, contrary to currently available vacuum assisted clothes dryers, the vacuum pump 36 of the present invention is directly affixed to the rotating drum 20, it is necessary to deliver electrical power from the fixed housing 11 to the drum 20 for operation of the vacuum pump 36. To this end, a power delivery system is implemented between a power source 41 (which my simply comprise the switched power from a conventional power cord 51 and electrical plug 52) on the fixed housing 11 and the drum 20. According to the preferred embodiment of the present invention, a slip ring assembly 42 is implemented about the spindle 34 extending between the rear end 33 of the drum 20 and the fixed housing 11. As is known to those of ordinary skill in the art, such a slip ring assembly 42 generally comprises a system of brushes 43 and rings 44 through which electrical power may be conveyed to a rotating object such as the drum 20. Exemplary of the slip ring assemblies suitable for implementation of the present invention are those slip assemblies commercially available from the Airflyte Electronics Company of Bayonne, N.J. Because the rotating drum 20 is maintained in its axis of rotation as previously described, power delivery through the slip ring assembly 42 is easily within the ability of one of ordinary still in the art.

As in currently available clothes dryers, it is desirable to provide heat to the interior space 28 of the rotating drum 20 to facilitate drying of clothing held therein. Unlike currently available clothes dryers, however, the clothes dryer 10 of the present invention contemplates no airflow to or from the interior space 28 of the rotating drum 20 other than the vacuum pressure communicated through the vacuum line 39 from the vacuum pump 36. As a result, the preferred embodiment of the present invention comprises a plurality of heating elements 30 distributed within the interior space 28. Although those of ordinary skill in the art will recognize the many alternatives available, Applicant has found it convenient to locate the heating elements 30 on the interior faces of paddles 29 provided for tumbling of the clothing held within the interior space 28.

While those of ordinary skill in the art will recognize the many substantial equivalents, Applicant has found suitable for implementation of the present invention the silicon rubber heater products commercially available from Watlow Columbia, Inc. of Columbia, Mo. Those products provide a reliable low-power source of heat at a temperature appropriate for use within the clothes dryer 10 with minimal risk for heat damage to the clothing held therein. As also will appreciated by those of ordinary skill in the art, the slip ring assembly 42 is readily adaptable for delivery of electrical power from the power source 41 to the heating elements 30.

As is also typical of currently available clothes dryers, the clothes dryer 10 of the present invention must contend with the moisture removed from the drying clothing. In the present invention, however, the moisture evaporated from the drying clothing is removed from the interior space 28 of the rotating drum 20 through the vacuum pump 36. In particular, an exhaust 38 from the vacuum pump 36 discharges water vapor into the interior of the fixed housing 11. As a result, the preferred embodiment of the present invention comprises an exhaust blower 49 adapted to force air from within the fixed housing 11 through an exhaust duct 50, which is preferably adapted for interface with a conventional household dryer vent. To ensure adequate air flow through the exhaust duct 50 for removal of the moist air within the fixed housing 11 an air intake grill 18 is preferably provided in the rear panel 17 of the fixed housing 11, thereby ensuring a continuous volume of airflow. Additionally, in the preferred embodiment of the present invention, the exhaust blower 49 is operated by an electric drive motor 47, which also preferably interfaces with and operates the drive assembly 48 rotating the drum 20.

In order to ensure that the vacuum seal 23 about the vacuum door 22 may be broken for access to the interior space 28 of the drum 20, a vacuum release 31 is preferably provided integral with the drum 20. As will be appreciated by those of ordinary skill in the art, a valve 32, which may be a stopcock valve, can economically perform this function. The user may then open the access door 13 by pulling the door 13 about its hinge 15 by a conventionally provided handle 14. The support arm 24 is also hinged to the front panel 12 of the fixed housing 11 such that the vacuum release 31 may be accessed prior to opening of the vacuum door 22.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, conventional leveling glides 19 may be provided as shown in the figures. Likewise, the clothes dryer 12 of the present invention may be provided with an automatic shut-off switch integral with the access door 13 through the fixed housing 11 as well as a timer for conventional shut-off of the dryer. Additionally, those of ordinary skill in the art will recognize that it may be desirable to provide a counterweight 40 opposite the spindle 34 from the vacuum pump 36 for insuring balanced rotation of the drum 20 upon the drum support system 45. In any case, because the scope of the present invention is much broader than any particular embodiment, the foregoing detailed description should not be construed as a limitation of the scope of the present invention, which is limited only by the claims appended hereto.

What is claimed is:

1. A vacuum assisted dryer for accelerated drying of clothing, said vacuum assisted dryer comprising:

a drum for holding clothing in a vacuum sealable interior space of said drum, said drum being rotatable relative to a fixed frame for tumbling clothing held within said interior space;

a vacuum pump fixedly attached to said drum, said vacuum source being adapted to communicate vacuum pressure to said interior space of said drum; and a power delivery system, said power delivery system being adapted to communicate electrical power from said fixed frame to said drum for powering said vacuum pump.

2. The vacuum assisted dryer as recited in claim 1, wherein said power delivery system comprises a slip ring assembly.

3. The vacuum assisted dryer as recited in claim 1, wherein said vacuum pump is mounted to an exterior surface of said drum.

4. The vacuum assisted dryer as recited in claim 3, said vacuum assisted dryer further comprising a counterweight, said counterweight being mounted to said exterior surface of said drum such that interference by said vacuum pump with rotation of said drum is avoided.

5. The vacuum assisted dryer as recited in claim 1, said vacuum assisted dryer further comprising a lint screen, said lint screen being interposed in the vacuum communication between said vacuum pump and said interior space of said drum.

6. The vacuum assisted dryer as recited in claim 1, said vacuum assisted dryer further comprising a heating element, said heating element being adapted raise the temperature of said interior space of said drum.

7. The vacuum assisted dryer as recited in claim 6, said vacuum assisted dryer further comprising a plurality of heating elements, each said heating element being adapted to raise the temperature of said interior space of said drum.

8. The vacuum assisted dryer as recited in claim 7, wherein said heating elements comprise heating pads.

9. The vacuum assisted dryer as recited in claim 8, wherein said drum comprises a plurality of paddles distributed about an interior face of said interior space, said paddles being adapted to cause tumbling of clothing held within said interior space during rotation of said drum.

10. The vacuum assisted dryer as recited in claim 9, wherein:

each said paddle is provided with a hollow space interior thereto; and each said heating pad is contained within said hollow spaces.

11. The vacuum assisted dryer as recited in claim 8, wherein said power delivery system is further adapted to communicate electrical power from said fixed frame to said heating pads.

12. The vacuum assisted dryer as recited in claim 1, wherein said vacuum pump is adapted to exhaust to an interior space of said fixed frame.

13. The vacuum assisted dryer as recited in claim 12, said vacuum assisted dryer further comprising a blower adapted to remove the exhaust of said vacuum pump from said interior space of said fixed frame.

14. The vacuum assisted dryer as recited in claim 13, wherein said fixed frame comprises an exhaust connection, said exhaust connection being adapted to interface with a household dryer vent.

15. The vacuum assisted dryer as recited in claim 1, said vacuum assisted dryer further comprising a vacuum relief for relieving vacuum pressure from within said drum.

16. The vacuum assisted dryer as recited in claim 15, wherein said vacuum relief comprises a valve in fluid communication with said drum.

17. The vacuum assisted dryer as recited in claim 16, wherein said valve comprises a stopcock.

18. A vacuum assisted dryer for accelerated drying of clothing, said vacuum assisted dryer comprising:

a drum for holding clothing in a vacuum sealable interior space of said drum, said drum being rotatable about a central spindle affixed to a fixed frame;

a vacuum pump fixedly attached to an exterior panel of said drum at a first radial position away from said spindle, said vacuum pump being adapted to communicate vacuum pressure to said interior space of said drum;

a counterweight for balancing said drum, said counterweight being fixedly attached to said exterior panel at a second radial position away from said spindle, said second radial position being generally opposite said first radial position; and a slip ring assembly about said spindle, said slip ring assembly being adapted to communicate electrical power from said fixed frame to said drum for powering of said vacuum pump.

19. The vacuum assisted dryer as recited in claim 18, said vacuum assisted dryer further comprising a plurality of heating elements distributed about an interior face of said drum, each said heating element being adapted to heat said interior space.

* * * * *